United States Patent [19]

Batke et al.

[11] Patent Number: 4,754,701

[45] Date of Patent: Jul. 5, 1988

[54] INK SEPARATING UNIT FOR FLEXO PRINTING MACHINERY

[75] Inventors: Manfred Batke, Augsburg; Franz X. Gollinger, Hirschbach; Wolfgang Obermair, Aichach-Unterwittelsbach, all of Fed. Rep. of Germany

[73] Assignee: M.A.N. Roland Druckmaschinen Aktiengesellschaft, Offenbach am Main, Fed. Rep. of Germany

[21] Appl. No.: 921,338

[22] Filed: Oct. 21, 1986

[30] Foreign Application Priority Data

Nov. 9, 1985 [DE] Fed. Rep. of Germany ..... 3539759

[51] Int. Cl.[4] ..... B41F 31/04

[52] U.S. Cl. ..... 101/207; 101/210; 101/208

[58] Field of Search ..... 101/207, 208, 350, 363, 101/157, 169, 210

[56] References Cited

U.S. PATENT DOCUMENTS

| | | | |
|---|---|---|---|
| 3,073,240 | 1/1963 | Tyma, Jr. et al. | 101/210 |
| 3,198,113 | 8/1965 | Feller | 101/208 |
| 3,585,932 | 6/1971 | Granger | 101/208 |
| 3,831,517 | 8/1974 | Wagner | 101/208 |
| 4,165,688 | 8/1979 | Leanna et al. | 101/207 |
| 4,461,211 | 7/1984 | Wesselmann et al. | 101/169 |
| 4,559,871 | 12/1985 | Kutzner et al. | 101/207 |
| 4,667,595 | 5/1987 | Geretzki | 101/207 |

FOREIGN PATENT DOCUMENTS

| | | | |
|---|---|---|---|
| 3320638 | 1/1985 | Fed. Rep. of Germany | 101/207 |

*Primary Examiner*—Edgar S. Burr
*Assistant Examiner*—Huong Q. Pham
*Attorney, Agent, or Firm*—Frishauf, Holtz, Goodman & Woodward

[57] ABSTRACT

To permit separating a flexograph ink trough, and flexograph ductor or trough roller into axial zones for respectively differently colored inks, a separating plate is located beneath the doctor blade which has a sealing element (7) attached thereto, resiliently engaging the underside of two doctor blades (2, 3), facing the ductor or trough roller (1) from different directions to permit operation of the ductor or trough roller (1) in either direction of rotation. A low-friction surface is applied to the edge which faces the ductor or trough roller, the sealing element spanning the space between the doctor blades and being matched to the circumference of the ductor or trough roller. The doctor blades extend axially beyond the sealing elements. The separating plates and sealing elements can be mounted on units which are axially positionable along an ink trough, and hence the ductor or trough roller, at selected positions, as required by the axial extent of differently colored inking zones.

13 Claims, 2 Drawing Sheets

INK SEPARATING UNIT FOR FLEXO PRINTING MACHINERY

Reference to related publication: German Patent Disclosure Document DE-OS No. 33 20 638, Kutzner et al, to which U.S. Pat. No. 4,559,271 corresponds.

The present invention relates to printing machinery, and more particularly to printing machines operating by the flexo print method, and an arrangement to permit separation of inks of different characteristics, for example of different colors with respect to axial zones on an ink ductor roller, against which at least one and usually two doctor blades are engaged.

BACKGROUND

U.S. Pat. No. 4,559,871, Kutzner et al, to which German Patent Disclosure Document DE-OS No. 33 20 638 corresponds, describes an arrangement in which two ink separating sheet metal elements in the form of ink dividing plates, are engaged by spring force directly against the circumference of a ductor roller, in order to separate differently colored inks from each other. The lateral sealing of the ink reservoir or ink sump region is obtained by engaging the separating elements against the face surfaces of the doctor blades or stripper blades. It has been found that it is difficult to obtain effective sealing of the respective compartments of the ink sump under all operating conditions, particularly when the ink is highly liquid or viscous, which is the case for example in flexo printing ink. The arrangement also does not permit the use of doctor or stripper blades which extend axially entirely across the length of the ductor roller; rather, the doctor blades must be dimensioned to match the number and length of the respective ink reservoir compartments. It has been found, additionally, that the circumferential surface of the ductor roller can be damaged by the separating sheet metal element. A ring of ink can remain on the ductor roller which, at high operating speeds, causes ink spray therefrom and, after long operating times, may leave a dried residue which is difficult to remove.

THE INVENTION

It is an object to provide an ink separating arrangement which avoids the disadvantages of the prior art, and, especially, insures sealing of different regions of the ink sump, which is simple, easily made and reliable in operation. The arrangement should, further, permit use of a single doctor or stripper blade and the separation in respectively different zones for, for example, different colors, should be placeable at random along the axial length of a ductor roller and one or more associated doctor or stripper blades.

Briefly, inking regions for inks of respectively different characteristics, typically different colors, are provided by engaging at least one ink separating plate, projecting essentially radially towards the ductor roller and furnishing said separating plate with a resilient sealing element, projecting beyond the separating plate. The resilient sealing element is located below the doctor or stripper blade and extends essentially radially adjacent beneath a portion of the ductor roller. A low-friction slide surface is formed at the engagement surface of the resilient sealing element in the region of engagement with the ductor roller. The doctor blade extends axially beyond the region of the engagement with the resilient element, which also permits use of a single doctor blade extending axially along the length of the ductor roller.

Usually, two doctor blades or stripper blades will be used to permit operation of the ductor roller in either direction of rotation; for arrangements of that kind, the ink separating plate and the resilient sealing element; engage both blades.

DRAWINGS

The drawings are highly schematic and any parts not necessary for an understanding of the present invention, and which may be of standard printing machinery construction, have been omitted from the drawings.

DETAILED DESCRIPTION

Figure 2:
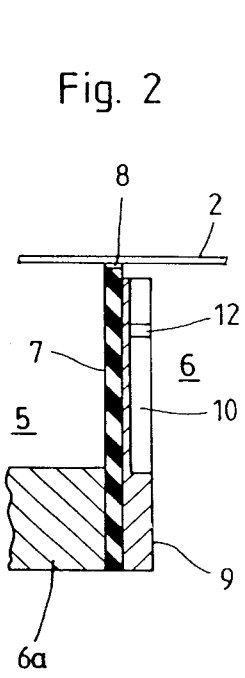
FIG. 2 is a cross-sectional schematic view along line II—II of FIG. 1 with the roller omitted.
Figure 1:
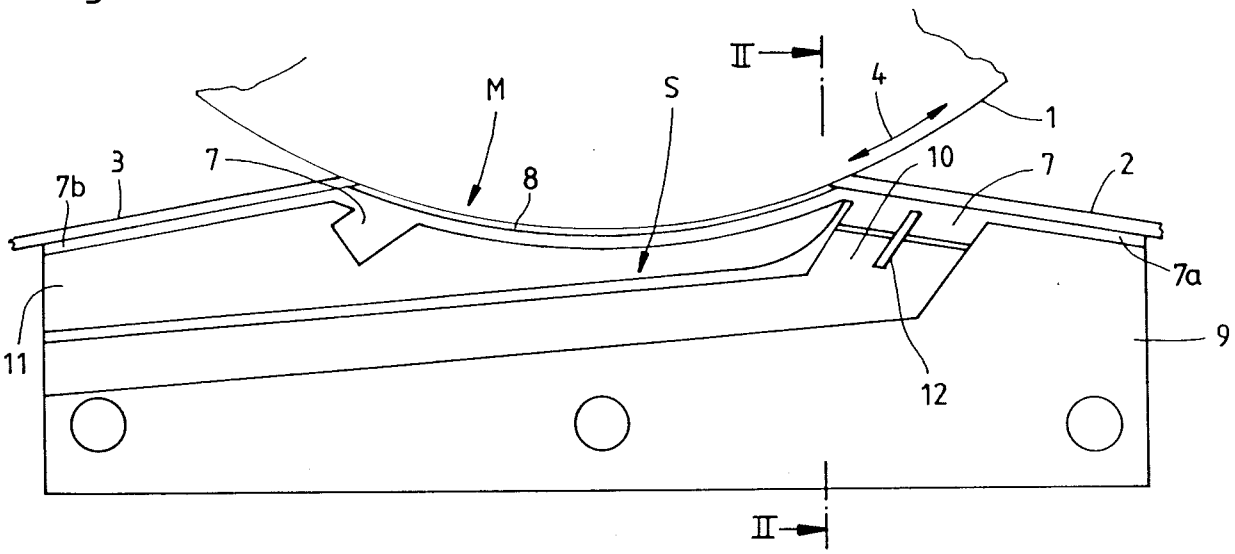
FIG. 1 is a highly schematic side view of the ink separating arrangement in accordance with the invention, for use with a two-doctor or stripper blade flexo printing inker.
Figure 3:
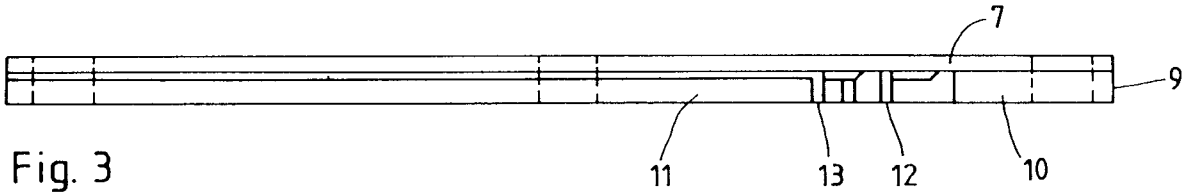
FIG. 3 is a top view of the ink separating arrangement of FIG. 1.

Referring first to FIGS. 1 to 3: An ink ductor roller 1, for example an Anilox roller, has doctor or stripper blades 2, 3 engaged thereagainst, in order to strip ink off the roller 1. The roller 1 can be operated in either direction of rotation, as schematically shown by the double arrow 4. An ink sump space S, having a bottom *6a;* is provided in order to catch ink stripped off the blade. The ink sump region S is located between the two blades 2, 3. If the machine is so arranged that the ductor roller 1 will always operate in only one single direction of rotation, a stripper blade 3 may be used instead of a doctor blade.

Often, the ductor or trough roller 1 should be inked, axially, with inks of different characteristics, typically with ink having different color. To provide for differently colored inking, in axial zones, the ink trough is separated into different trough portions or compartments 5, 6—see FIG. 4. It is frequently necessary to print on substrates with different colors in zones of different widths; this will require change of the width of the ink trough compartments 5, 6 with respect to their axial extent.

In accordance with a feature of the invention, the subdivision of a single ink trough into ink trough compartments can be easily effected while, at the same time, providing for differently colored ink zones on the trough roller by use of insert units which separate the ink trough into the different compartments. The arrangement in accordance with the present invention permits use of continuous doctor or stripper blades 2, 3, without requiring axially separate or subdivided doctor blades or stripper blades, and, at the same time, not causing any damage to the ductor or trough roller.

In accordance with a feature of the invention, a separating plate 9 (FIGS. 1–3) is located transversely across the ink trough to separate the ink trough into the respective compartments, for example to separate the ink trough compartment 6 from the compartment or portion 5. In accordance with a feature of the invention, the separating plate 9 is covered by a portion of a sealing element 7 (see FIG. 2). The sealing element 7 has a portion which extends over the associated circumferential portion M of the trough roller 1—see FIG. 1. The sealing element 7 has a slide surface machining the circumference of roller 1 located at the edge thereof immediately adjacent the trough roller 1. The sealing element 7 is of a rubbery or elastomeric substance, for example natural rubber or neoprene. The slide surface or slide coating 8, suitably, is made of Teflon (®).

In accordance with a feature of the invention, seal 7 is so constructed and attached to the plate 9 that it engages the underside of the doctor blade 2 with an extension 7*a*. An extension 7*b*, circumferentially removed from the extension 7*a*, engages beneath the respectively used doctor blade or stripper blade 3. The extensions 7*a*, 7*b* are elastically engaged against the flat underside surfaces of the respective blades. The seal 7, looked at in direction of rotation of the trough roller 1, is, thus, at all times, located in advance of the respective blade. This has the advantage that, in spite of unavoidable bend-through of the respective blade 2 or 3, an exact and precise seal will be maintained. The portion of seal 7 which extends along the circumferential zone M of the trough roller 1 is part-circular, with the radius thereof matched to the radius of the trough roller 1 and, in order to protect the trough roller 1, is coated with the sliding or slippery material 8.

By forming the separating plate 9 with the seal 7 in the manner explained, the lateral portion of any ink trough reservoir section will be reliably sealed. It is, however, still unavoidable that some ink will escape. In accordance with a feature of the invention, and preferably, the ink separating plate 9 is formed with recesses 10, 11, defining drip-off or flow-off channels or ducts, which insure that any ink which escapes will not dry and cake, or will be flung off by centrifugal force. Rather, the recesses 10, 11 will guide such escaped ink or ink particles along the separating plate 9 for eventual run-out to an ink reservoir or ink collection device—not further shown, and of standard construction. In accordance with a preferred feature, the respective recesses can be separated by ribs 12, 13 which also provide for guidance and direction of ink which drips or runs off.

Figure 4:
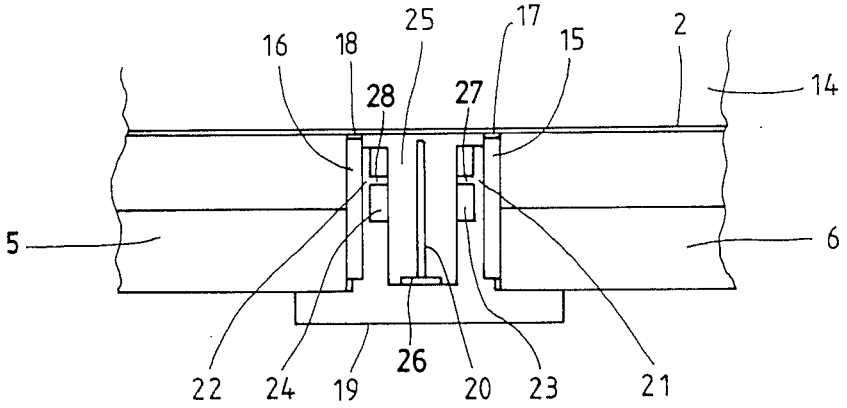
FIG. 4 illustrates an insert push-in arrangement for two ink separating elements.

FIG. 4 illustrates a preferred arrangement in which two seals 15, 16, each one of the type described, are applied to two respective ink separating plates 21, 22. Each one of the seals 15, 16, which may be identical to the seal 7 referred to above, can be adhered to respectively opposite sides of the plates 21, 22. The ink separating plates 21, 22, together with the seals 15, 16, are assembled to an insert or slider element 19 which can be placed at any desired axial position against a trough roller 14 to subdivide the ink trough as well as the trough roller into axial zones. The insert or slide-in assembly 19 then separates the ink trough into two trough compartments 5, 6 which, for example, may retain ink of different colors. Seals 15, 16 are coated with a slide coating 17, 18, similar to the slide coating 8 of FIGS. 1–3. The ink separating plates 21, 22 are formed as recesses 23, 24 which, preferably, are also subdivided by ribs 27, 28.

Some ink may escape laterally from the troughs 5, 6 into a gap 20, formed in the assembly. The gap 20 is located within a central support element 25, retaining the respective separating plates 21, 22 on the unit 19 and secured thereto as shown at 26. The gap 20, preferably provided for ease of insertion, may have ink collect therein which is guided off for collection in an ink sump or ink reservoir.

As can be seen, the insert or slide arrangement 19 can be placed anywhere axially along the trough roller 14, so that the axial extent of the respectively subdivided portions 5, 6 of the ink trough can be arranged as desired for any particular printing job. Ink ring formation on the respective trough roller 1, 14 is effectively prevented by providing for lateral extent of the respective doctor blade or stripper blade 2, 3 over and beyond the lateral extent of the respective ink separating plate 9 or 21, 22. Of course, if a single doctor blade is used in the arrangement of FIG. 4, the doctor blade will, automatically, laterally extend from alignment with the respective trough compartment 5, 6, therebeyond and towards the central gap 20 in the center support portion 25 of the insert unit 19.

Various changes and modifications may be made within the scope of the inventive concept.

We claim:

1. In combination with an inker of a printing machine operating in the flexographic printing mode, wherein the printing machine has a ductor or trough roller (1);

an ink trough (S; 5, 6) located adjacent the circumference of the ductor roller;

and a doctor blade (2, 3) located below and projecting towards the circumference of the ductor or trough roller (1), means for separating inking regions axially along the ductor or trough roller to separate said ink trough into separated ink trough portions (5, 6), to permit use of inks of respectively different characteristics, both within the ink trough (S, 5, 6) and on the circumference of the ductor or trough roller (1), said separating means including at least one ink separating plate (9, 21, 22) projecting essentially radially towards the ductor or trough roller (1);

a resilient sealing element (7, 15, 16) projecting beyond the at least one separating plate, located below the doctor blade (2, 3), said resilient sealing element having an engagement surface which extends radially against a circumferential portion (M) of the ductor or trough roller (1);

said engagement surface being provided with a low-friction slide coating (8; 17, 18) in the region of said resilient sealing element which contacts said circumferential portion (M) of the ductor or trough roller and wherein said doctor blade (2, 3) extends axially along the ductor or trough roller (1) and over all of said separated portions (5, 6) of the ink trough.

2. The combination of claim 1, wherein the respectively different characteristics of the inks are different colors.

3. The combination of claim 1, wherein the ink separating plate (9, 21, 22) at a side remote from the respective ink trough portion (S; 5, 6) is formed with ink drainage ducts or recesses (10, 11; 23, 24).

4. The combination of claim 3, further comprising ribs (12, 13) separating said drainage ducts or recesses.

5. The combination of claim 1, wherein two ink separating plates (21, 22) are provided; and a holder unit (19, 25) is provided, connecting together said two ink separating plates, said ink separating plates being each provided with a resilient sealing element (15, 16), the resilient sealing elements being located on the ink separating plates, to provide an insert unit formed of separating plates, and sealing elements, each with a respective slide surface (8) thereon for placement against a doctor blade at any selected axial position of the ductor or trough roller (1).

6. The combination of claim 1, wherein two doctor blades (2, 3) are provided, directed against the ductor or trough roller (1) from opposite direction to permit operation of the ductor or trough roller (1) in either direction of rotation;

and wherein the circumferential portion (M) of the resilient sealing element (7) spans the space between the two doctor blades.

7. The combination of claim 6, wherein the low-friction slide surface (8, 17, 18) extends throughout an edge of the sealing element (7) along said circumferential portion (M) to provide for low-friction engagement with the ductor or trough roller (1) and with adjacent portions of the doctor blades (2, 3).

8. The combination of claim 7, wherein the respectively different characteristics of the inks are different colors.

9. The combination of claim 7, wherein the ink separating plate (9, 21, 22) at a side remote from the respective ink trough portion (S; 5, 6) is formed with ink drainage ducts or recesses (10, 11; 23, 24).

10. The combination of claim 9, further comprising ribs (12, 13) separating said drainage ducts or recesses.

11. The combination of claim 5, wherein said holder unit (19) comprises a support element (25) formed with an ink drainage gap (20), said ink drainage gap communicating with recesses (23, 24) formed in the separating plates (21, 22).

12. The combination of claim 6, wherein two ink separating plates (21, 22) are provided; and a holder unit (19, 25) is provided, connecting together said two ink separating plates, said ink separating plates being each provided with a resilient sealing element (15, 16), the resilient sealing elements being located on the ink separating plates, to provide an insert unit formed of separating plates, and sealing elements, each with a respective slide surface (8) thereon for placement against a doctor blade at any selected axial position of the ductor or trough roller (1).

13. The combination of claim 12, wherein said holder unit (19) comprises a support element (25) formed with an ink drainage gap (20), said ink drainage gap communicating with recesses (23, 24) formed in the separating plates (21, 22).

* * * * *